United States Patent [19]

Butka

[11] Patent Number: 4,939,840

[45] Date of Patent: Jul. 10, 1990

[54] SAFETY RAZOR

[76] Inventor: Kemal Butka, 372 Central Park West, Apt. 20J, New York, N.Y. 10025

[21] Appl. No.: 339,231

[22] Filed: Apr. 14, 1989

[51] Int. Cl.[5] ..... B26B 21/00; B26B 21/08; B26B 19/38; B26B 19/48

[52] U.S. Cl. ..... 30/37; 30/38; 30/50; 30/51

[58] Field of Search ..... 30/48–51, 30/54, 77, 37, 35, 38, 43.7

[56] References Cited

U.S. PATENT DOCUMENTS 4,302,876 12/1981 Emmett ..... 30/50

4,442,598 4/1984 Jacobson ..... 30/50

4,492,024 1/1985 Jacobson ..... 30/50

4,551,916 11/1985 Jacobson ..... 30/50

4,709,477 12/1987 Ferraro ..... 30/50

4,774,765 10/1988 Ferraro ..... 30/50

*Primary Examiner*—Douglas D. Watts

*Assistant Examiner*—Paul M. Heyrana

*Attorney, Agent, or Firm*—Michael J. Striker

[57] ABSTRACT

A safety razor comprises a handle, a blade element movable relative to the handle in a direction which substantially corresponds to the direction of a working stroke, and an elastic element located between the handle and the blade element as considered in this direction.

4 Claims, 5 Drawing Sheets

SAFETY RAZOR

BACKGROUND OF THE INVENTION

The present invention relates to safety razors.

It is well known that safety razors are widely used for shaving and produced in a variety of different constructions. One of the most important requirements for safety razors is to produce mild and smooth strokes, and also to provide an efficient cutting action so as to reliably remove the hair. It is to be understood that an improvement in these characteristics is highly desirable.

SUMMARY OF THE INVENTION

Accordingly, it is an object of the present invention to provide a safety razor with improved characteristics as compared with existing safety razors.

More particularly, it is an object of the present invention to provide a safety razor which insures a mild and smooth shaving stroke.

It is also a further object of the present invention to provide such a safety razor in which the cutting action is enhanced.

In keeping with these objects and with others which will become apparent hereinafter, one feature of the present invention resides, briefly stated, in a safety razor which has a handle, a blade element which is movable relative to the handle in a direction corresponding to the direction of a shaving stroke, and an elastic element formed as spring, located between said handle and said blade element as considered in this direction.

When the safety razor is designed in accordance with the above specified features of the present invention, it provides a mild and smooth shaving stroke.

In accordance with another feature of the present invention, the elastic element is elastically displaceable in at least one direction which is transverse to the shaving stroke and connected with the blade element, so that the blade element during the shaving stroke is additionally displaced in the transverse direction.

Still a further feature of the present invention is that the elastic element is formed so that during the shaving stroke its portions move in two opposite transverse directions and connected with two separate blade members of the blade element, so that during the shaving stroke the blade members are displaced in two opposite transverse directions.

Finally, an additional feature of the present invention is that the safety razor is provided with means for retaining a sharpening element which is brought in contact with the blade element and during the transverse movement of the blade element the latter is sharpened.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
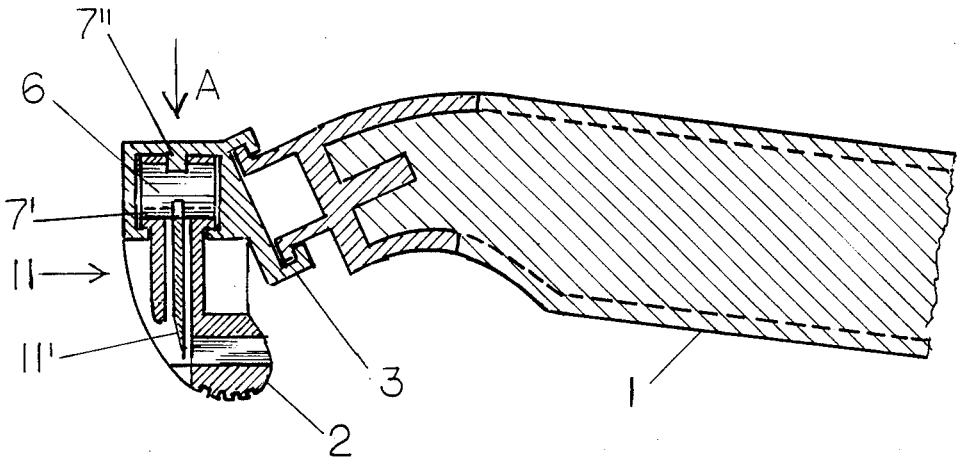
FIGS. 1 and 2, are a side view and front view of the safety razor in accordance with one embodiment of the present invention in which a spring element is provided between a handle and a blade element and connected with them.
Figure 2:
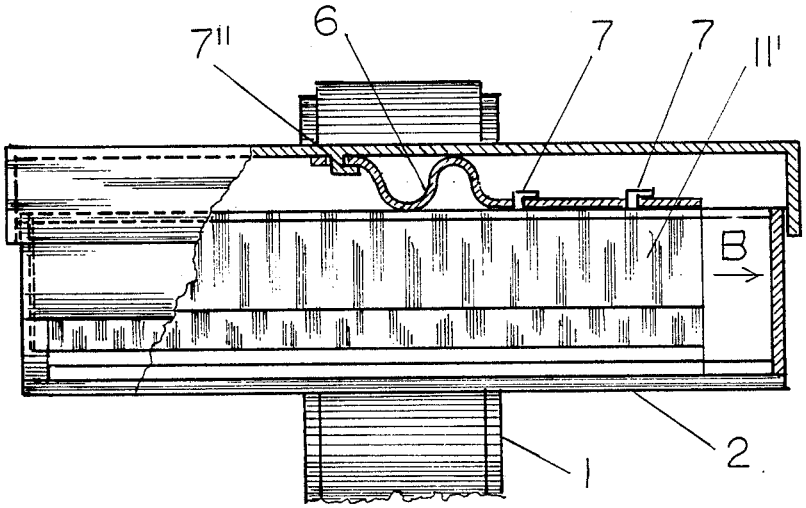

A safety razor in accordance with a first embodiment shown in FIGS. 1 and 2 has a handle which is identified with reference numeral 1 and a head 2 which is removably connected with the handle by interengaging projections 3. A blade element which is identified as a whole with reference numeral 11 is received in an opening provided in the head 2. The blade element shown in the drawings has a blade When the blade element 11 is received in the opening of the head 2, a space is retained between the upper surface of its horizontal projection and the lower surface of the upper wall of the head 2 as can be seen in the drawings. An elastic element is located in the above mentioned space and formed as a spring.

During a shaving when a user performs a working stroke in a direction which is identified with reference numeral, A, the blade element 11 together with the blade 11' is slightly movable relative to the head 2. As a result, the shaving stroke is milder and smoother. The skin throughout the surface to be shaved, but particularly around the jaw bones is therefore protected from cuts, irritations, etc. It should be emphasized that this protection is performed automatically, without special steps to be taken by a user or attention on his part. In the embodiment of FIGS. 1 and 2 one end of the spring is fixedly connected with the head 3, while the other end of the spring is movably connected with the blade 11'. The connections can be performed in various ways. For example, the first end of the spring can be welded to the head 3, while the second end of the spring can be connected to the blade 11' by extensions 7 provided on the blade. As can be seen from the drawings, the spring has at least one convolution.

In this embodiment when the safety razor is displaced in the direction of the working stroke A, and a force is applied to the head 3 while the cutting edge of the blade 11' is in contact with a surface to be shaved, the spring 6 is compressed in a direction corresponding to the direction of the working stroke and expands in a transverse direction. Its end which is fixedly connected with the blade 11' displaces the blade 11' in a transverse direction identified with the arrow B. As a result, the blade 11' obtains a transverse displacement in this direction. This transverse displacement during the working stroke enhances the cutting action. When the pressure applied to the handle 1 is somewhat released, the spring 6 springs back and returns the blade to its initial position. Since during the shaving this pressure is repeatedly applied and released the repeated transverse movement of the blade 11' is provided.

Figure 3:
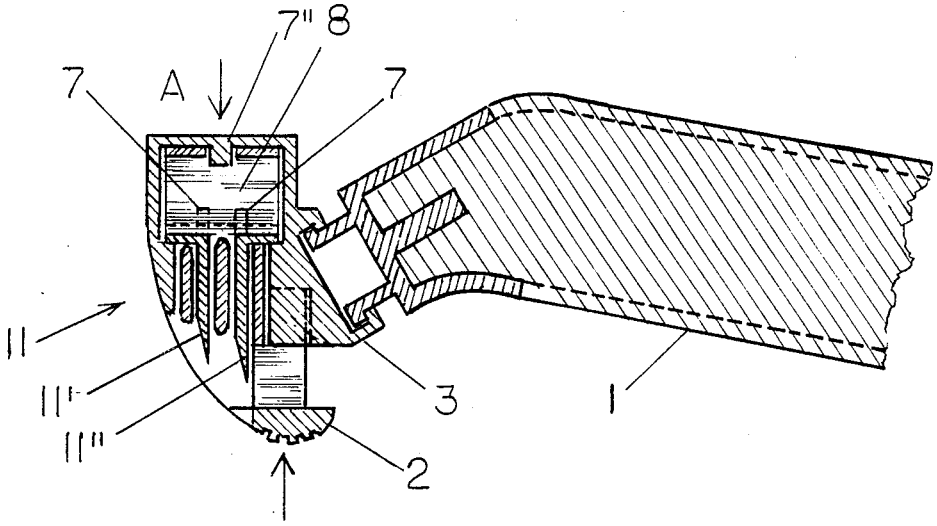
FIGS. 3 and 4 are a side view and a front view of another embodiment of the safety razor, in which the spring element between the handle and the blade element has two ends connected with two blades of the blade element.
Figure 4:
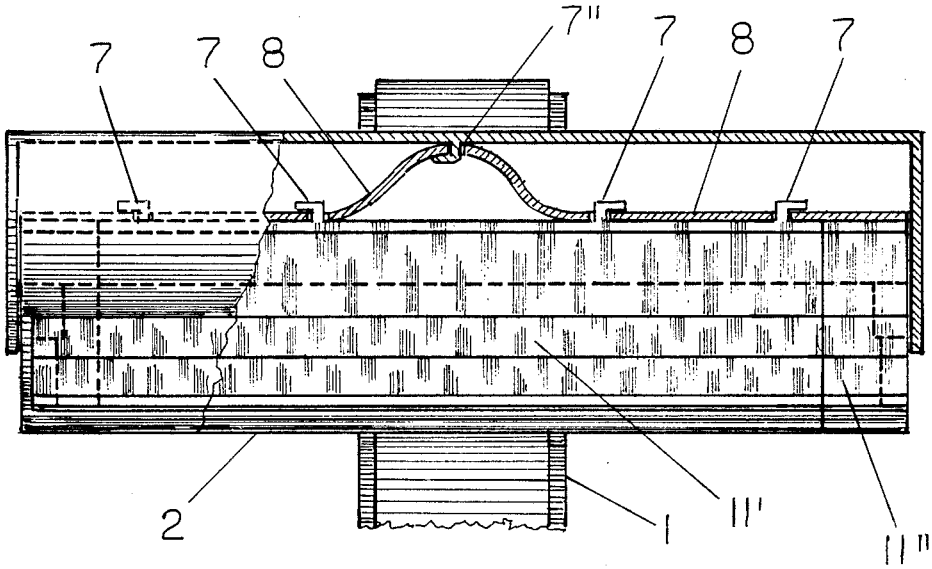

FIGS. 3 and 4 show a next embodiment of the inventive safety razor. Here, the elastic element is formed somewhat differently from the elastic elements of the previous embodiments. The elastic element is formed as a spring 8 which has for example one bend and two opposite ends arranged so that one end of the spring 8 is connected with one blade 11' while the other end of the spring 8 is connected with the other blade 11" by the extensions 7. The band is connected in its apex to the head 2 for example by welding.

During the working stroke in direction of the arrow A the force is applied to the handle 1, and the blades 11' and 11" abut against the surface to be shaved. Under the action of the force the bend of the spring 8 is compressed, and the ends of the spring 8 move in two opposite directions. The blades 11' and 11" connected with these ends are also displaced in two opposite transverse directions. When the pressure on the handle is released the spring 8 returns to its initial position and pulls the blades to their initial position as well. During the shaving, repeated transverse movements are performed by the blades 11' and 11" in the opposite directions. This further enhances the cutting action of the safety razor.

Figure 5:
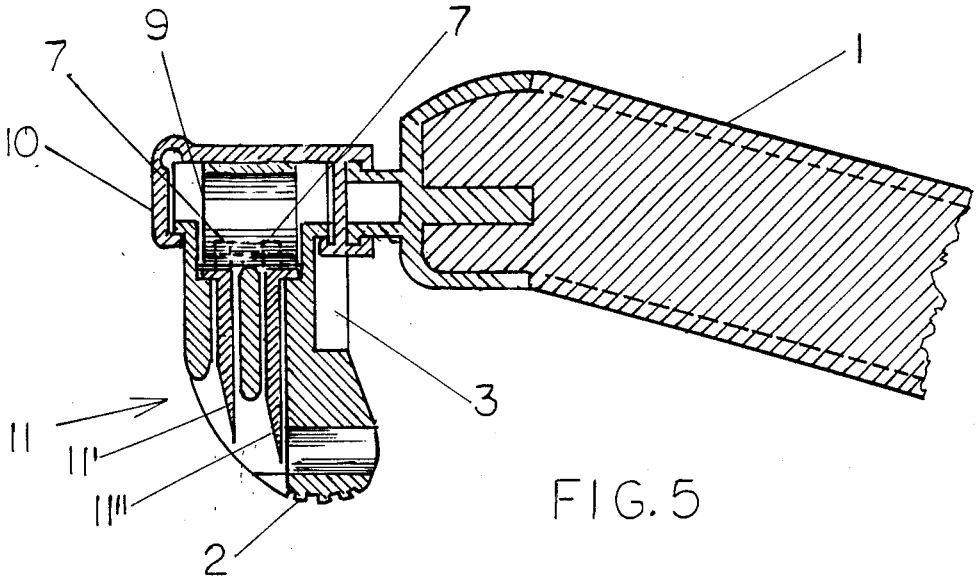
FIGS. 5 and 6 are a side view and a front view of still another embodiment of the safety razor, substantially corresponding to the embodiment of FIGS. 3 and 4, but showing the spring element provided with two bands.
Figure 6:
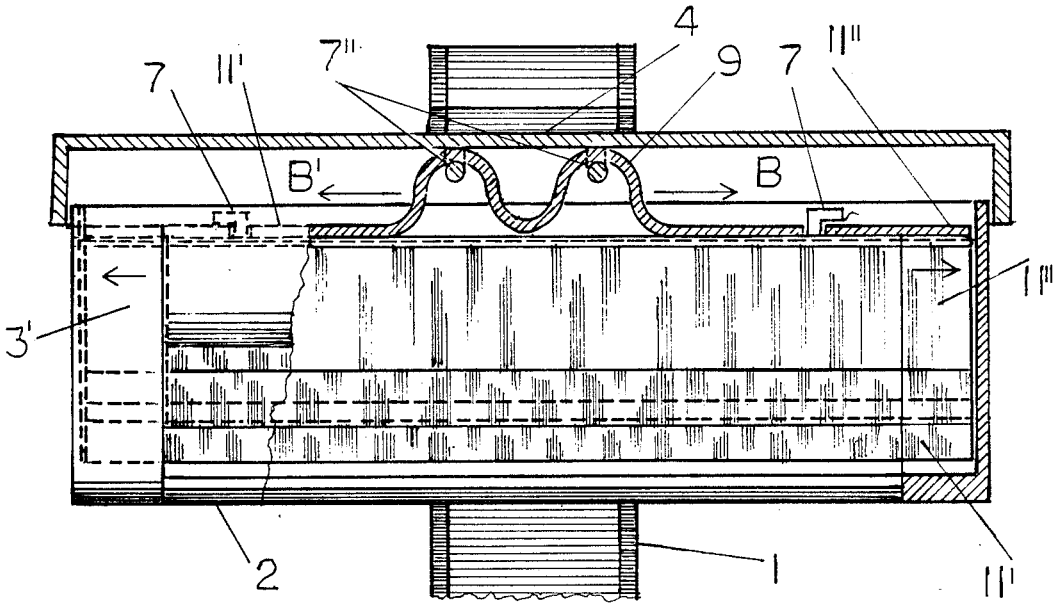
Figure 7:
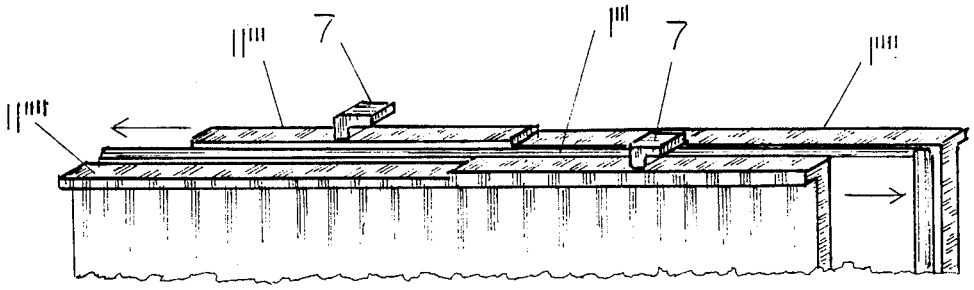
FIGS. 7 and 7A are perspective views showing a portion of the blades and a connection of the blades with a spring element.
Figure 7A:
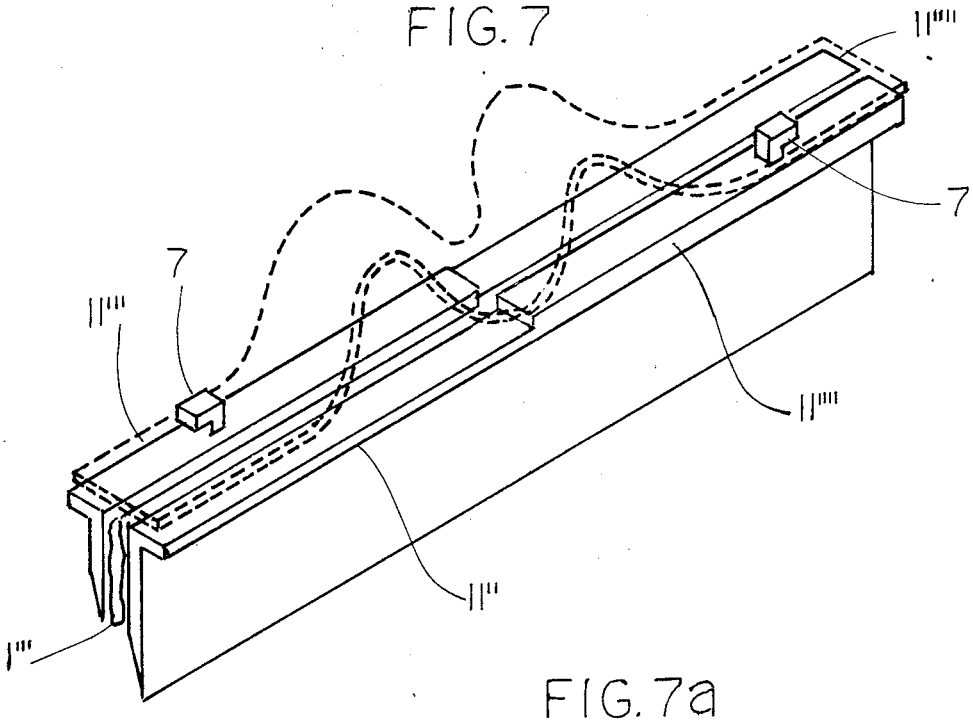

In the embodiment shown in FIGS. 5–7, an elastic element is formed as a spring 9 which has two opposite ends each connected to a respective one of the blades 11' and 11'. The spring 9 has two bends which however are not connected with any stationary part of the safety razor. As can be seen from FIG. 7, the head is supported in an intermediate element 10 attached to the handle 1, and the blades together with the spring move in the direction of the shaving stroke A relative to the intermediate element.

During the working stroke when the force is applied to the handle 1 and the blades 11' and 11" abut against a surface to be shaved, the tends of the spring 9 are compressed and the ends of the spring move in two opposite directions so as to displace the blades 11' and 11" in these directions which are identified as B and B'. When the force applied to the handle 1 is somewhat released, the spring 9 pulls the blades 11' and 11" to their initial position. The blades are provided with a raised portion 1''' which is connected to the respective end of the spring 9. With such a construction, during expansion and retraction of the spring 9 it does not rub against an upper surface of a lowered portion 11'''' of the respective blade.

Figure 8:
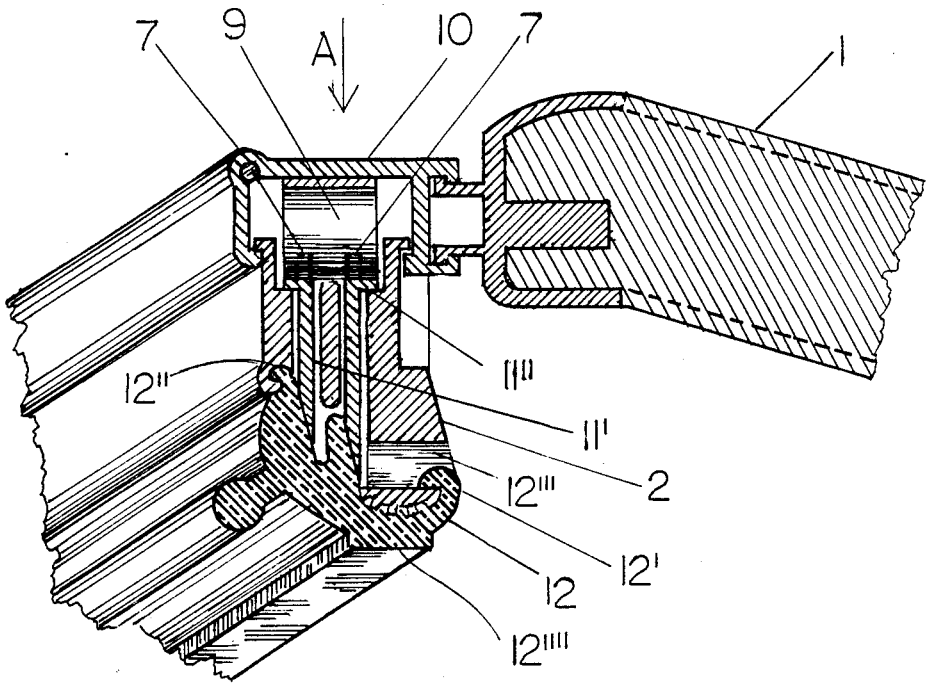
FIG. 8 is a view showing still a further embodiment of the present invention for sharpening the blades.

Finally, FIG. 8 shows a construction in which the blades can be easily sharpened. An abrasive element 12 can be removably attached to the head 2. The attachment can be performed by engagement of two projections 12' and 12" into respective recesses formed in the head 2. The abrasive element 12 has a shaped working surface identified with reference numeral 12''' and formed so that when the abrasive element 12 is attached to the head 2, the working surface 12" is in contact with the cutting edges of the blades 11' and 11". The abrasive element 12 has further a supporting surface 12''''.

When the abrasive element 12 is attached to the head 2 of the safety razor and placed on a supporting surface with its surface 12'''', and a force is applied to the handle 1 in the direction of the arrow A, the blades 11' and 11" perform a transverse movement under the action of the spring 9 formed for example in accordance with the embodiment of FIGS. 5–9. During the transverse movement the cutting edges of the blades 11' and 11" are sharpened by rubbing against the working surface 12'''' of the abrasive element 12.

It will be understood that each of the elements described above, or two or more together, may also find a useful application in other types of constructions differing from the types described above.

While the invention has been illustrated and described as embodied in a safety razor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety razor, comprising a handle; a blade element movable relative to said handle in a direction which substantially corresponds to the direction of a working stroke of the safety razor during shaving; and an elastic element cooperating with said handle and said blade element and formed as a spring, said spring having one portion fixedly connected with said blade element and another portion acted upon by a force applied to said handle during a shaving stroke, said spring having two opposite ends and at least one bend located therebetween, said blade element having two blades, said one portion being formed by said ends of said spring so that one of said ends of said spring is connected with one of said blades while the other of said ends of the spring is connected with the other of said blades, said other portion acted upon by said handle is formed as said bend.

2. A safety razor as defined in claim 1, wherein said bend is fixedly connected with said handle.

3. A safety razor as defined in claim 1, wherein said bend is movable relative to said handle.

4. A safety razor, comprising a handle; a blade element movable relative to said handle in a direction which substantially corresponds to the direction of a working stroke of the safety razor during shaving; and an elastic element cooperating with said handle and said blade element and formed as a spring, said spring having a first portion fixedly connected with said blade element and a second portion acted upon by a force applied to said handle during a shaving stroke; and further comprising a sharpening element attachable immovably relative to said handle so as to be in contact with a cutting edge of said blade element so that during said movement of said blade element said cutting edge is sharpened by rubbing against said sharpening element.

* * * * *